US007971286B2

(12) United States Patent
Dillen, II et al.

(10) Patent No.: US 7,971,286 B2
(45) Date of Patent: Jul. 5, 2011

(54) SWIMMING POOL WITH BENCH SEATING MODULE

(75) Inventors: William A. Dillen, II, Middletown, PA (US); Robert E. Seitz, York, PA (US)

(73) Assignee: Fox Pool Corporation, York, PA (US)

( * ) Notice: Subject to any disclaimer, the term of this patent is extended or adjusted under 35 U.S.C. 154(b) by 515 days.

(21) Appl. No.: 12/075,060

(22) Filed: Mar. 7, 2008

(65) Prior Publication Data

US 2009/0222982 A1 Sep. 10, 2009

(51) Int. Cl.
*E04H 4/00* (2006.01)

(52) U.S. Cl. ..... 4/496; 4/578.1; 4/499; 4/501; 4/492; 4/511; 312/235.8

(58) Field of Classification Search ..... 4/496, 578.1, 4/499, 501, 492, 488, 511; 63/238; 312/235.8; 68/238

See application file for complete search history.

(56) References Cited

U.S. PATENT DOCUMENTS

| | | | | |
|---|---|---|---|---|
| 3,596,296 | A | 8/1971 | Gertz | |
| 3,952,338 | A | 4/1976 | Troxclair | |
| 4,034,425 | A * | 7/1977 | Van Riemsdyck | 4/576.1 |
| D287,620 | S | 1/1987 | Delepine | |
| 4,661,247 | A | 4/1987 | Weir et al. | |
| 4,797,957 | A | 1/1989 | Weir et al. | |
| 5,228,148 | A * | 7/1993 | Weir | 4/496 |
| 5,333,322 | A * | 8/1994 | Weir | 4/496 |
| 5,678,256 | A | 10/1997 | Lea | |
| 5,916,099 | A | 6/1999 | Hall | |
| D491,277 | S | 6/2004 | Erdelac et al. | |
| 6,859,954 | B2 | 3/2005 | Collins et al. | |
| D510,630 | S | 10/2005 | Sullivan | |
| D514,708 | S | 2/2006 | Sullivan | |
| 2004/0003549 | A1 * | 1/2004 | Lawson | 52/168 |

* cited by examiner

*Primary Examiner* — Gregory L Huson
*Assistant Examiner* — Lauren Heitzer
(74) *Attorney, Agent, or Firm* — Stuart J. Friedman

(57) ABSTRACT

A modular occupant bench unit for use in a swimming pool formed from a plurality of contiguous modular wall panels joined end-to-end to define a pool enclosure having a vertical perimeter wall includes a vertical wall having opposite ends adapted to be joined with contiguous wall panels and being substantially coplanar with the vertical walls of the wall panels and an elongate bench protruding from the vertical wall between the top and bottom thereof into the pool substantially beyond the plane formed by the vertical wall of the pool, the upper side of the bench defining an occupant seating area and the underside being spaced from the floor of the pool. A plurality of hydrotherapy jets are spaced apart along the vertical wall above the upper side of said bench and below the water line of the swimming pool.

11 Claims, 6 Drawing Sheets

SWIMMING POOL WITH BENCH SEATING MODULE

FIELD OF THE INVENTION

The present invention relates generally to a swimming pool which incorporates a seating bench that projects into the interior of the pool from the vertical pool wall. The present invention also relates to a swimming pool which incorporates a stair that projects into the interior of the pool from either an arcuate wall or corner defined between two vertical pool walls.

BACKGROUND OF THE INVENTION

One popular manner of constructing a swimming pool is by connecting a plurality of modular wall panels end-to-end to form the swimming pool. Frequently, the enclosure thus formed is not watertight and a flexible liner covers the end-to-end connected modular walls and the bottom of the swimming pool. Typical swimming pools of modular construction are disclosed, for example, in U.S. Pat. No. 3,596,296-Gertz, U.S. Pat. No. 4,661,247-Weir et al and U.S. Pat. No. 4,797,957-Weir et al. One or more of the modular walls may be omitted during construction and substituted with a modular seating unit, as is disclosed, for example, in U.S. Pat. No. 5,228,148-Weir.

The availability of a seating means to permit a swimmer to rest or lounge in a comfortable position in a swimming pool is a desirable convenience in a pool. While it is possible to lower a chair or stool, or even a seating module as is disclosed in U.S. Pat. No. 5,333,322, into a swimming pool as a seating means, this is awkward, difficult, often uncomfortable and, sometimes, hazardous. For example, in U.S. Pat. No. 5,333,322, there is disclosed a drop-in or add-on seat module for a swimming pool which rests upon the pool liner wall and/or the pool bottom and comprises two side-by-side bucket seats, limiting seating to two persons. As such, these drop-in units trap or restrict water flow behind and/or underneath and/or within the cavity formed by the unit upon the pool wall and/or pool bottom and can be a source of algae growth within the pool. It is also known, particularly for application to modular pools, from U.S. Pat. No. 5,228,148, to provide a seating module which may be substituted for a standard perimeter wall module within the modular perimeter wall of the swimming pool. The module of U.S. Pat. No. 5,228,148 has its two bucket seats recessed within the wall of the pool such that the seats do not protrude into the swimming pool beyond the plane formed by the vertical wall of the swimming pool. In an embodiment of the module of U.S. Pat. No. 5,228,148, the seat module includes a stairway recessed within the wall of the pool which is positioned adjacent the recessed seats. Like the seats, the stairway does not protrude into the swimming pool beyond the plane formed by the vertical wall of the swimming pool. This type of recessed modular unit creates a recess or well extending into the deck surface at the bucket seats and at the stairway.

Accordingly, there is a need for a modular seating area for modular pools which does not utilize deck space to provide the seating area, can accommodate more than two persons, provides freedom of movement of the legs, such as for kicking the water while seated, and is not confining to sit in but, rather, permits a person seated thereon to stretch out. Efforts to date directed at providing such a module suffer from one or more shortcomings. This is because prior art efforts at providing modular seating elements are either uneconomical to manufacture, hazardous and/or cumbersome or difficult to install or use. Accordingly, there remains a need for a simple, inexpensive to manufacture, easy to install, durable bench-type module for modular swimming pools.

SUMMARY OF THE INVENTION

It is, therefore, a primary object of the present invention to provide a modular bench-type seating element which is integral with the structural wall of a swimming pool, but which protrudes into the interior of the pool.

It is another object of the present invention to provide a modular bench-type seating element which takes up no deck space to provide the seating area.

It is yet another object of the present invention to provide a modular bench-type seating element which permits persons seated on the bench-type seating element to kick their lower legs in the water without striking any part of their feet on the pool wall.

It is still another object of the present invention to provide a modular bench-type seating element which provides 360° vertically oriented accessibility to the bench seating area.

It is another object of the present invention to provide a modular stair element which is integral with the structural wall of a swimming pool, but which protrudes into the interior of the pool and which defines a seating area into which at least one hydrotherapy jet provides a flow of water.

It is yet another object of this invention to provide a bench-type seating element and/or stair element for swimming pools which each comprise a modular unit and each of which can be integrated into the wall of the swimming pool by replacing one or more of the standard modular wall panels of the pool.

The foregoing and other objects are achieved in accordance with the present invention by providing a modular occupant bench seating unit for use in a swimming pool formed from a plurality of contiguous modular wall panels joined end-to-end to define a pool enclosure having a vertical perimeter wall, said pool having a floor and being adapted to be filled with water to a water line along the vertical perimeter wall, said bench unit comprising a module devised to replace one of said modular wall panels and adapted to be joined with said contiguous wall panels, said bench module comprising:

a vertical wall having a top, a bottom and opposite ends, said opposite ends adapted to be joined with contiguous wall panels, said vertical wall being substantially coplanar with the vertical walls of said contiguous wall panels; and an elongate bench having an elongate side protruding from said vertical wall between the top and bottom thereof into said pool substantially beyond the plane formed by the vertical wall of the pool, said bench having an upper side and an under side, said upper side defining an occupant seating area and said underside being spaced from the floor of said pool.

In another aspect of the present invention, a plurality of hydrotherapy jets are spaced apart along the vertical wall of the bench module above the upper side of the bench and below the water line of the swimming pool.

In yet another aspect of the present invention, the under side of the bench is spaced sufficiently from the floor of the swimming pool to allow occupants seated on the bench to position their lower legs beneath the bench. At the same time, the bench protrudes a sufficient distance from the vertical wall of the bench module to allow occupants seated on the bench to kick their lower legs without striking their feet on the vertical wall.

In still another aspect of the present invention, there is provided a modular stair unit for use in a swimming pool formed from a plurality of contiguous modular wall panels joined end-to-end to define a pool enclosure having a vertical perimeter wall, said pool having a floor and being adapted to be filled with water to a water line along the vertical perimeter wall, said stair unit comprising a module devised to replace one of said modular wall panels and adapted to be joined with said contiguous wall panels, said stair module comprising:

a vertical wall having a top, a bottom and opposite ends, said opposite ends adapted to be joined with contiguous wall panels, said vertical wall being substantially coplanar with the vertical walls of said contiguous wall panels; and at least two substantially planar steps having horizontal tread and respective risers extending downwardly and protruding from said vertical wall into said pool, the top step being recessed below the top of said vertical wall, at least one of said steps defining a seating area for supporting a person seated thereon, said vertical wall including at least one hydrotherapy water jet above said seating area and below the water line of said swimming pool for providing a flow of water into said seating area.

DESCRIPTION OF THE PREFERRED EMBODIMENTS

Figure 1:
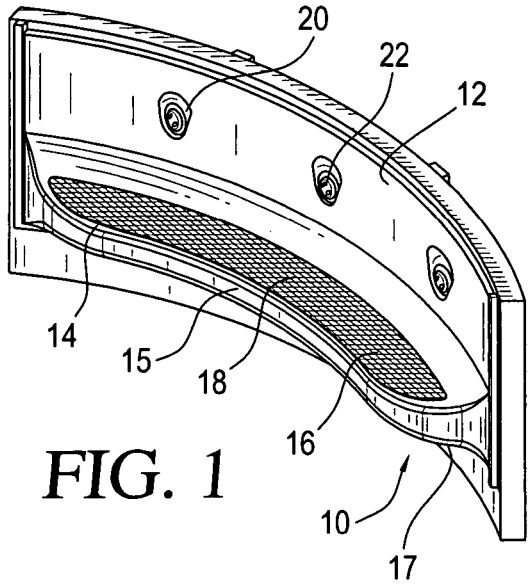
FIG. 1 is a perspective view of a curved bench-type seating module of the present invention.

The seating module of the invention, in its preferred embodiment, contemplates the substitution of a bench-type seating module for a modular wall panel of a swimming pool which is formed from a plurality of contiguously joined modular wall panels. A purchaser of a swimming pool, therefore, for a relatively minor additional expense, may include in the purchase a seating module which is integrated into the pool wall and in which the seating bench projects from the pool wall into the interior of the pool, but does not extend downwardly into contact with the pool floor. In effect, the bench-type seating module fills the opening in the pool wall perimeter resulting from omitting one or more "standard" modular wall panels and completes the interior perimeter of the swimming pool structure. Unlike the seating modules of the prior art, the seat portion, e.g., the bench, of the instant seating module protrudes into the swimming pool substantially beyond the plane formed by the vertical wall of the swimming pool but does not extend downwardly to the pool floor, thus allowing space between the pool floor and the underside of the seat portion for the legs of a person seated on the bench. Stated otherwise, there is no riser wall extending downwardly to the pool floor from the elongate side of the bench which protrudes into the swimming pool. This permits a person seated on the bench to kick his/her lower legs, as people commonly do in swimming pools, without striking one's feet either on a riser wall or on the vertical pool wall. In addition, it allows the purchaser of the pool to install the bench seating module wherever desired in the pool wall right up to the time of pool wall assembly without affecting the pool liner design or construction. This is because with the shelf-type bench seat of the present invention, no specially designed liner is required whereas, if there were a riser wall extending downwardly to the pool floor from the elongate side of the bench which protrudes into the swimming pool, a specially designed pool liner would be required to accommodate the riser wall. In addition to the added versatility of location placement afforded by the bench seating module of the present invention, there is the additional benefit of the cost saving attributed to not needing a specially designed pool liner. Moreover, unlike the confining bucket seats shown in prior art seating modules, the instant protruding bench permits 360° vertically oriented accessibility, i.e., accessibility in a vertical plane, to the bench seating area. A person seated on the modular bench of the present invention can turn sideways and lie on the bench surface with legs outstretched or with bent knees and feet in contact with the bench surface. In addition, depending upon the size of the people using the modular bench unit, it can comfortably accommodate at least three people, and possibly more. The seating module of the invention may be used with any of a variety of standard commercially available swimming pools that are constructed from a plurality of modular wall panels that are joined end-to-end to form the perimeter of the swimming pool, including rectangular shaped pools and free form shaped pools.

Figure 17:
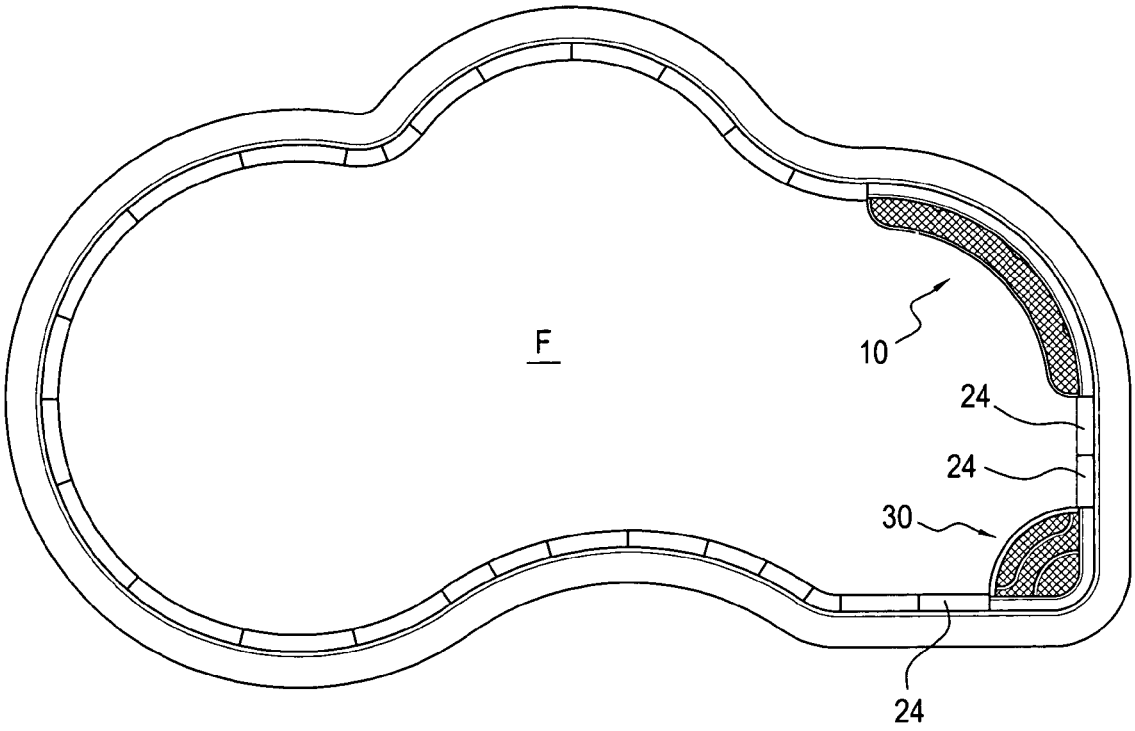
FIG. 17 is a top plan view of a swimming pool showing the curved bench-type module and corner stair module installed in the perimeter wall of a modular pool and projecting from the pool wall into the interior of the pool.
Figure 18:
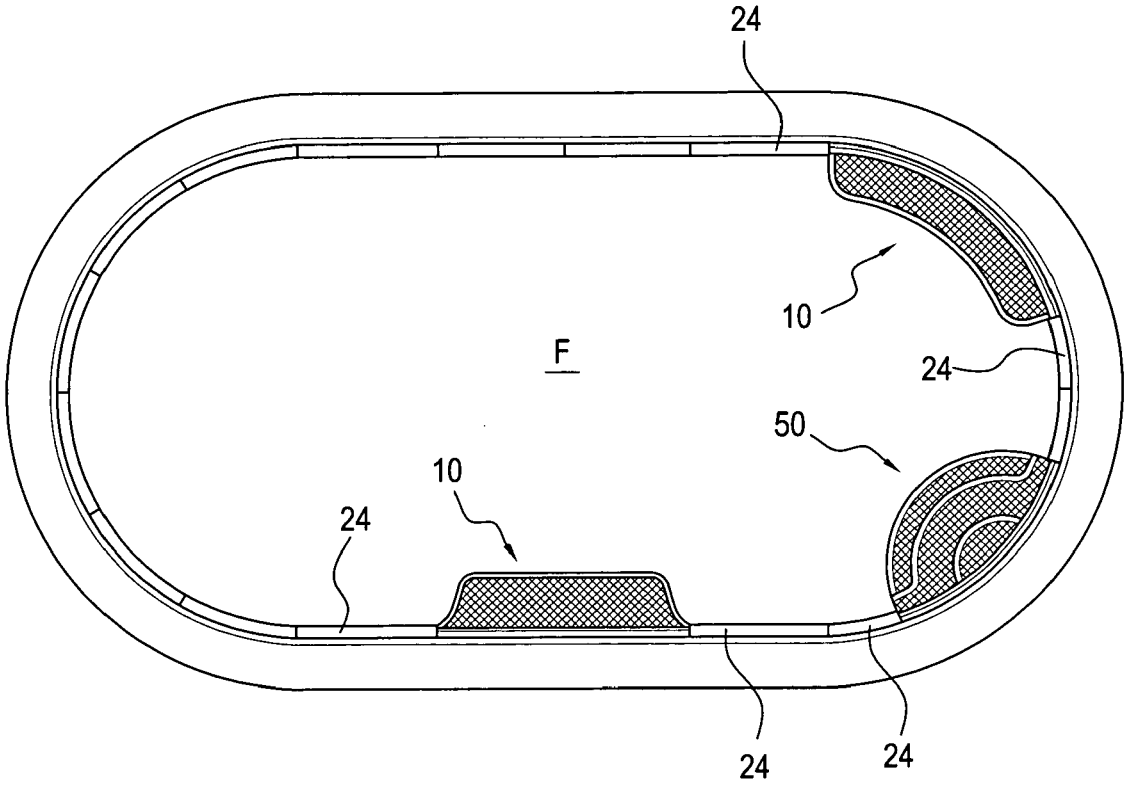
FIG. 18 is a top plan view of a swimming pool showing the curved and straight bench-type modules and a curved inner stair module installed in the perimeter wall of a modular pool and projecting from the pool wall into the interior of the pool.

Referring to FIGS. 1-8, In its simplest form, the seating module 10 comprises a vertical perimeter wall or back wall 12 and an elongate bench portion 14 protruding therefrom at substantially a right angle thereto, in the nature of a shelf. The seating portion 16 of the bench 14 includes a slip resistant tread pattern 18, such as the well known diamond tread pattern. In a preferred embodiment, the intersection of the back wall 12 with the seating portion 16 of bench 14 is gently curved to avoid sharp corners, the elongate side 15 of the bench 14 protruding into the pool has a sufficiently small vertical dimension to allow a person seated on the bench 14 to bend his/her leg at the knee such that the lower end of the leg is beneath the bench 14 and the underside 17 of bench portion 14 rapidly merges into the back wall 12, intersecting the back wall 12 well above the floor F of the pool. This allows persons seated on the bench 14 to kick their lower legs, as people commonly do in swimming pools, without striking their feet on the vertical back wall 12. Jet nozzle recesses 20 are formed in the back wall 12 above the bench 14 for the installation of hydrotherapy jets 22. It is desirable that both the bench 14 and the nozzles of the jets 22 are located below the swimming pool water line W when the seating module 10 is in place and secured to the contiguous wall panels 24 (see FIGS. 17 and 18) and the pool is filled with water. As illustrated in FIGS. 1-4, the perimeter of the back wall 12 is arcuate or curved, which is suitable for swimming pool shapes such as oval, lagoon or kidney shaped pools. However, it will be appreciated that the shape of the back wall 12 and the corresponding shape of the bench 14 may be adapted to fit the shape of the swimming pool by selecting shapes which are appropriate for replacing "standard" modular wall panels at the selected location along the pool perimeter. As illustrated in FIGS. 5-8, the perimeter of the back wall 12 is straight and the bench 14, likewise, is straight, which is suitable for replacing a straight modular wall panel in virtually any shaped pool. Whatever the planar shape of the pool vertical wall as defined by the contiguous wall panels 24, i.e., straight or curved, the vertical wall 12 of bench seating module 10 is coplanar therewith.

A seating element is desirable as a simple, yet important resting accommodation, especially for the elderly, and also for making available the benefits of the therapeutic treatment of the kind that is derived from the use of turbulent water expelled against the body of an occupant of the bench. The water expelled from the jets 22 positioned along the back wall 12 of the seating module 10 may be warmed from the swimming pool water heater (not shown), which is well known in the art. Pressurized air furnished by an air generating means (not shown), which is also well known in the art, is preferably fed through suitable valve means and mixed with the heated water to produce a therapeutic turbulent water flow at the nozzles of jets 22. Any suitable number of such jets 22 may be employed, depending upon the length of the bench 14. Generally, positioning the nozzles of the jets 22 spaced apart at approximately two foot intervals along the back wall 12 of the seating module 10 is sufficient.

The seating module 10 is generally of a molded design of one piece construction and is provided with securing flanges at each side of the bench seat, the flanges being adapted to be secured to and mate with the flanges of contiguous wall panels 24 by means which are conventional in the art. In one embodiment, the connection between adjacent panels are formed to be substantially water tight by suitable caulking or by incorporating a rubber or other yieldable composition gasket where the ends of the seating module connect to the respective ends of the contiguous wall panels. In another embodiment, the pool includes a flexible liner which covers the walls and bottom of the swimming pool to define a water holding container. The vinyl liner is attached/sealed to the substantially vertical surfaces of the seating module 10 by compressing the vinyl liner into a gasket or caulking material using a faceplate and screws or other mechanical means of compression to create a watertight seal on the substantially vertical surfaces of the seating module 10. As indicated previously, no specially designed liner is required as would be the case if there were a riser wall extending downwardly to the pool floor from the elongate side of the bench which protrudes into the swimming pool.

Figure 2:
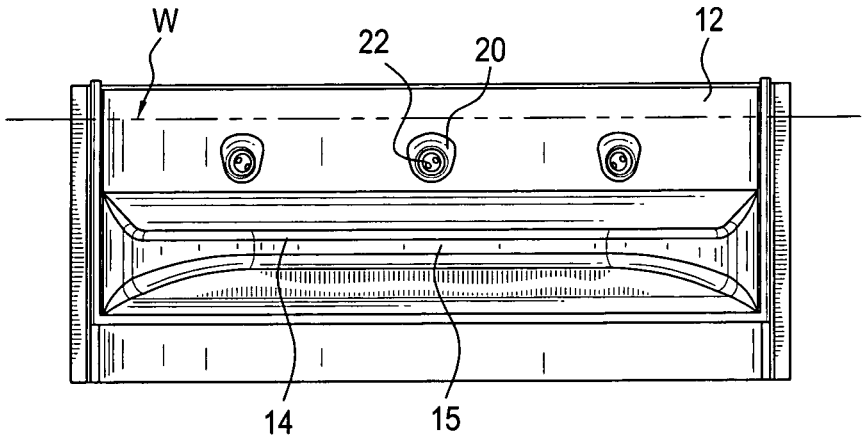
FIG. 2 is a front elevational view of the curved bench-type seating module of FIG. 1.
Figure 4:
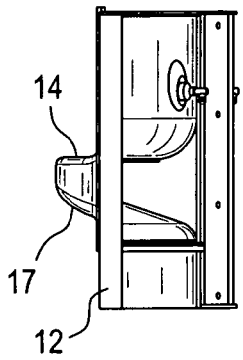
FIG. 4 is a side elevational view of the curved bench-type seating module of FIG. 1.
Figure 3:
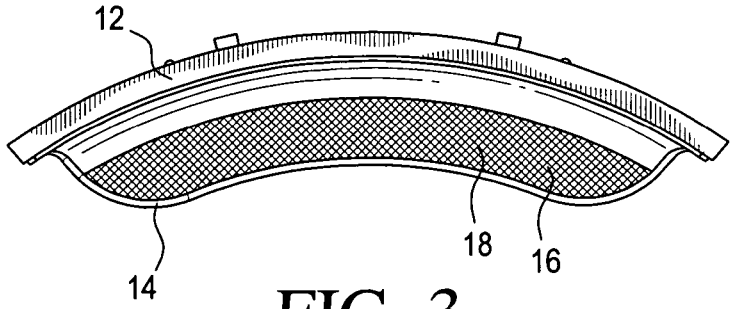
FIG. 3 is a plan view of the curved bench-type seating module of FIG. 1.
Figure 5:
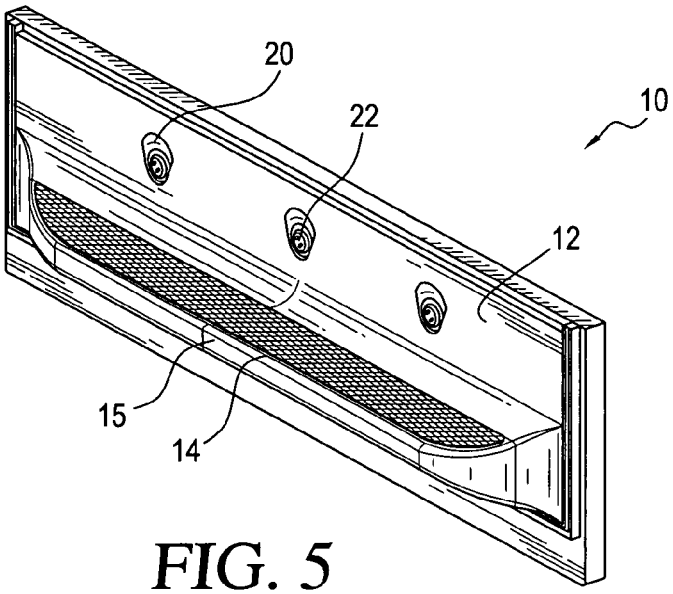
FIG. 5 is a perspective view of a straight bench-type seating module of the present invention.
Figure 6:
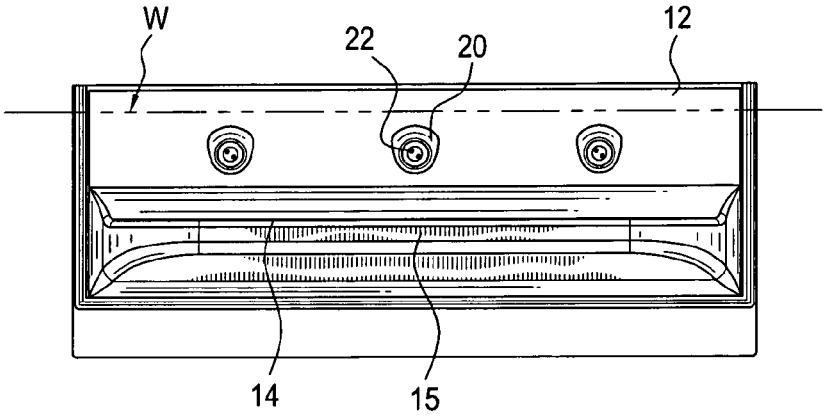
FIG. 6 is a front elevational view of the straight bench-type seating module of FIG. 1.
Figure 8:
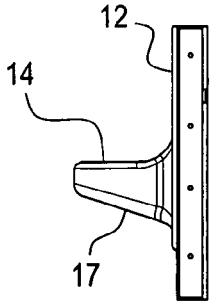
FIG. 8 is a side elevational view of the straight bench-type seating module of FIG. 1.
Figure 7:
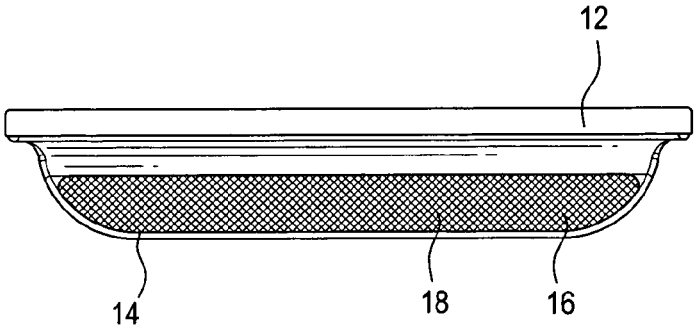
FIG. 7 is a plan view of the straight bench-type seating module of FIG. 1.
Figure 9:
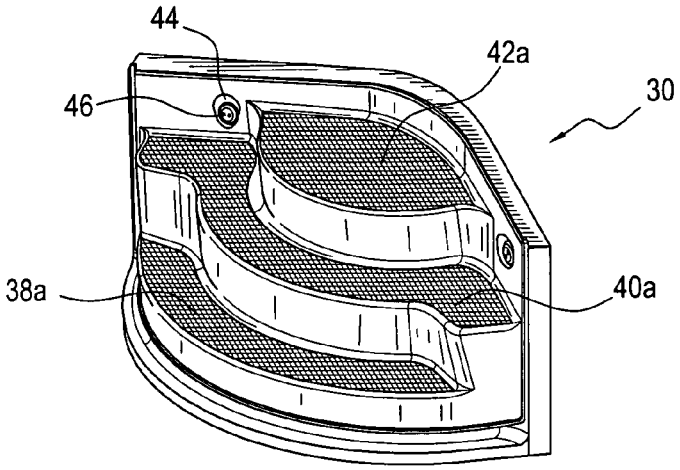
FIG. 9 is a perspective view of a corner stair module of the present invention.

For purposes of illustration only, a typical seating module 10 might have a length along the back wall 12 measured from left to right in FIGS. 2 and 6, for example, of about 8 feet, a back wall vertical height of about 40 inches, bench seating portion 16 protruding from the back wall 12 about 18-20 inches down from the top of the back wall 12, a bench depth from its protruding elongate side 15 to the back wall 12 of about 14-16 inches and a bench 14 thickness between its upper and lower surfaces at its protruding elongate side 15 of about 4-6 inches. A typical seating module 10 might also include three hydrotherapeutic jets 22 equally spaced along and mounted in the back wall 12 about 10-12 inches below the top of the back wall 12 and spaced apart by about 24 inches. The bench seating portion 16 and the hydrotherapeutic jets 22 should at all times be below the water line W of the pool when the pool is filled with water.

Referring to FIGS. 9-12, there is shown a corner stair module 30 which, like the seating module 10 is intended to be substituted for a "standard" wall module at a selected location around the perimeter of the swimming pool. From the particular shape of the corner stair module of FIGS. 9-12, it is intended for installation at a corner of a pool, preferably at the shallow end, where swimmers are likely to want to enter or leave the pool. As shown, it comprises three steps with the tread of each step including a slip resistant surface, such as a diamond tread pattern. However, it will be appreciated that, depending upon the size and depth of the pool and the desired height of each step, there may be more or fewer steps in any stair module. A purchaser of a swimming pool, therefore, for a relatively minor additional expense, may include in the purchase a corner stair module 30 which is integrated into the pool wall and in which the stairs project, progressively, from top to bottom, from the pool wall into the interior of the pool. Not only does the stair module allow ingress into and egress from the pool, but also each of the steps provides a seating area where one or more persons can, if desired, sit.

Referring to FIGS. 9-12, there is shown a corner stair module 30 which, like the seating module 10, is shown with an arcuate perimeter back wall 32 defining the intersection between side walls 34, 36. However, it will be appreciated that the shape of the back wall and the corresponding shape of the stair module may be adapted to fit the shape of the swimming pool by selecting shapes which are appropriate for replacing "standard" modular wall panels at the selected location along the pool perimeter. As shown, corner stair module 30 comprises three steps 38, 40, 42 protruding from vertical back wall 32 into the pool, with the tread 38*a*, 40*a*, 42*a* of each step including a slip resistant surface, such as a diamond tread pattern, and each step includes a riser portion 38*b*, 40*b*, 42*b* between it and the next lower step or floor. Desirably tread 42*a* of step 42 is positioned below the top 32*a* of vertical back wall 32 such that back wall 32 serves as a riser for the step from tread 42*a* to the deck surface surrounding the pool. Tread 42*a* of top step 42 includes a curvilinear outer edge defining an approximately quarter circular arc. The treads 40*a*, 38*a* of the second and lower steps 40, 38 also include generally curvilinear outer edges which are generally concentric with each other and with the curvilinear outer edge of top step 42. It will be appreciated that, depending upon the size and depth of the pool and the desired height of each step, there may be any number of steps, not less than two, in any stair module.

Figure 10:
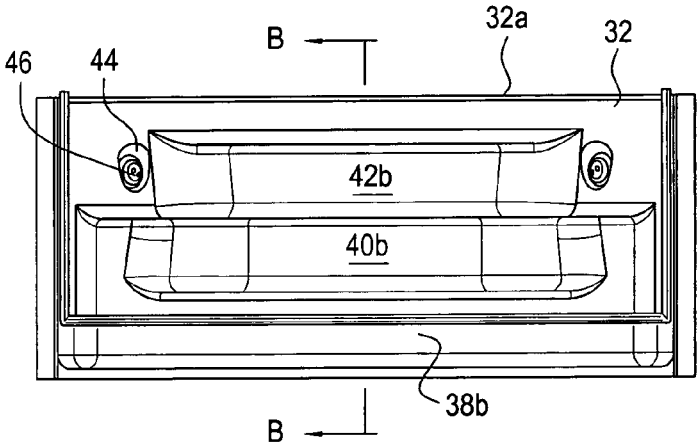
FIG. 10 is a front elevational view of the corner stair module of FIG. 9.
Figure 12:
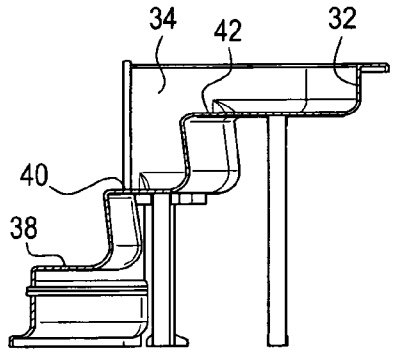
FIG. 12 is a sectional view of the corner stair module taken along line B-B of FIG. 10.
Figure 11:
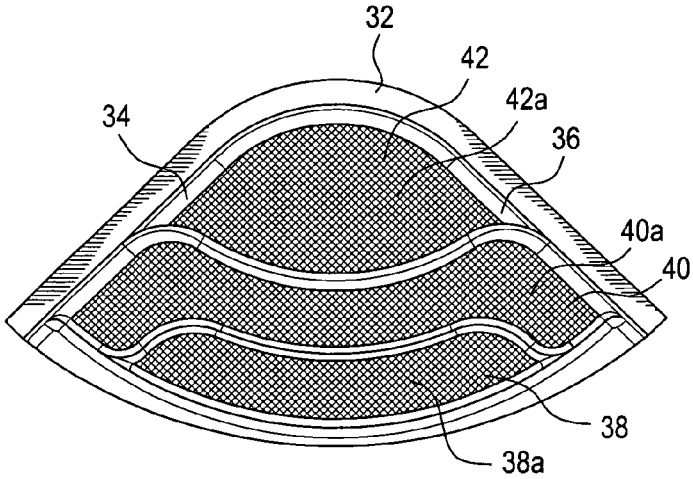
FIG. 11 is a plan view of the corner stair module of FIG. 9.
Figure 13:
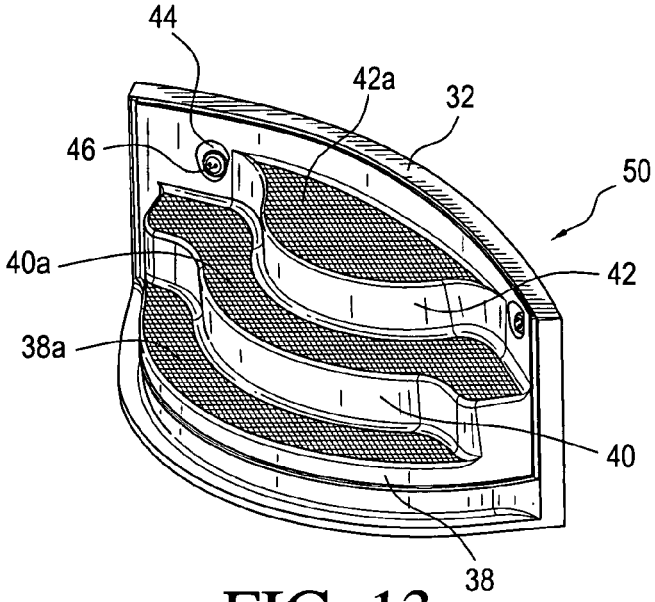
FIG. 13 is a perspective view of an internal curved stair module of the present invention.
Figure 14:
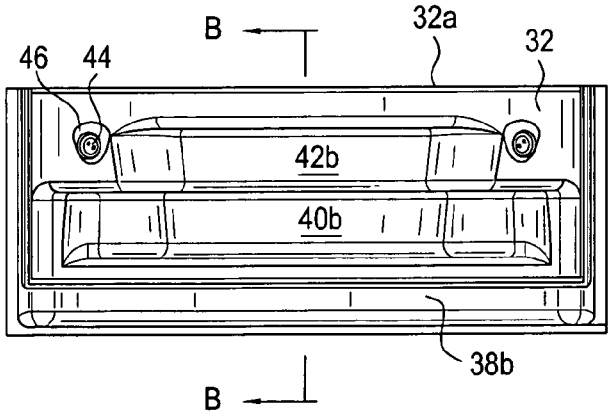
FIG. 14 is a front elevational view of the curved stair module of FIG. 13.
Figure 16:
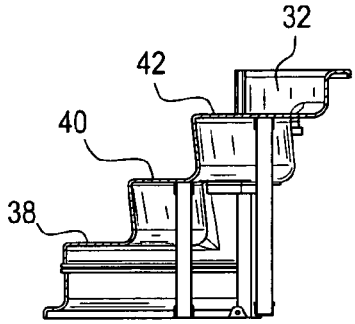
FIG. 16 is a sectional view of the curved stair module taken along line B-B of FIG. 14.
Figure 15:
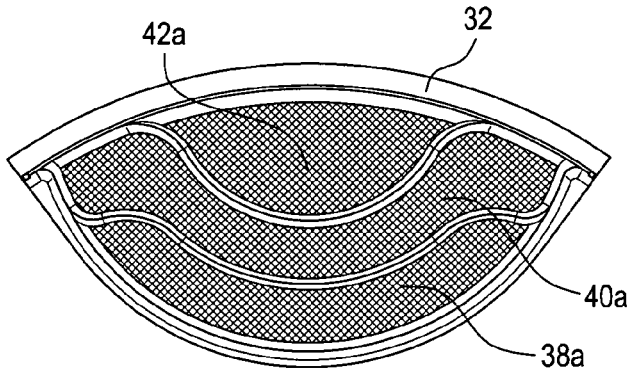
FIG. 15 is a plan view of the curved stair module of FIG. 13.

Like the bench seating module 10, the corner stair module 30 also makes available the benefits of hydrotherapeutic treatment of the kind that is derived from use of turbulent water expelled against the body of a person sitting or standing on the steps by providing jet nozzle recesses 44 along the side walls 34, 36 of the corner stair module 30 for the installation of hydrotherapy jets 46. The water expelled from jets 46 positioned in the side walls 34, 36 of the corner stair module 30 may be warmed from the swimming pool water heater (not shown), which is well known in the art. Pressurized air furnished by an air generating means (not shown), which is also well known in the art, is preferably fed through suitable valve means and mixed with the heated water to produce a therapeutic turbulent water flow at the nozzles of jets 46. Any desired number of such hydrotherapy jets 46 may be employed. For example, as shown in FIG. 10, jets are shown projecting through each side wall 34, 36 of the corner stair module 30 at a height between the treads 38*a*, 40*a* of the middle and upper steps 38, 40. However, it will be appreciated that the number and location of the jets 46 is a matter of design choice and may differ from pool to pool. Of particular note is that corner stair module 30 serves not only to allow persons to enter and leave the pool in a convenient manner, but also it provides a seating area, e.g., at the ends of middle step 40, where hydrotherapeutic treatment is available via hydrotherapy jets 46.

As illustrated in FIGS. 9-12, the perimeter of the back wall 32 is arcuate and defines a corner between side walls 34, 36, which is suitable for installation in the corner of a pool, usually in the shallow end. However, it will be appreciated that the shape of the back wall 32 and the corresponding shape of the modular stair 30 need not define a corner stair but may define any straight or arcuate shape for installation as a replacement for any modular wall of the swimming pool perimeter. Thus, the back wall 32 may be adapted to fit the shape of the swimming pool by selecting shapes which are appropriate for replacing "standard" modular wall panels at selected locations along the pool perimeter other than in a corner. Such stair modules will be referred to herein as internal stair modules 50. As illustrated in FIGS. 13-16, the perimeter of the back wall 32 is arcuate, which is suitable for replacing a correspondingly arcuate modular wall panel in virtually any shaped pool. Except for the configurational changes required to accommodate an arcuate back wall instead of a corner back wall, e.g., in the length of arc of the steps of the internal stair module 50 and in the structural wall support system (not shown), the construction of the internal stair module 50 is substantially the same as the corner stair module 30.

Suitable valve means and safety shut off controls for governing water flow quantity, turbulence generation, temperature adjustment, and the like, all of which are known in the art, may be incorporated in the seating module and stair modules to control the hot water and turbulence available at the jets. In addition, the manner of attaching the seating and stair modules to contiguous wall panels in the swimming pool perimeter is substantially the same and well known in the art.

While the present invention has been described in terms of specific embodiments thereof, it will be understood that no limitations are intended thereby to the details of construction or design, other than as defined in the appended claims.

The invention claimed is:

1. A modular occupant bench seating unit for use in a swimming pool formed from a plurality of contiguous modular wall panels joined end-to-end to define a pool enclosure having a vertical perimeter wall, said pool having a floor and being adapted to be filled with water to a water line along the vertical perimeter wall, said bench unit comprising a module devised to replace one of said modular wall panels and adapted to be joined with said contiguous wall panels, said bench module comprising:

a vertical wall having a top, a bottom and opposite ends, said opposite ends adapted to be joined with contiguous wall panels, said vertical wall being substantially coplanar with the vertical walls of said contiguous wall panels to define said vertical perimeter wall of said pool; and an elongate bench unitary with said vertical wall, said bench having an elongate side protruding from said vertical wall between the top and bottom thereof into said pool substantially beyond the plane formed by the vertical wall of the pool, said bench having an upper side and an under side, said upper side defining an occupant seating area and said underside being spaced from the floor of said pool, said bench providing 360° vertically oriented accessibility to the occupant seating area.

2. A modular bench unit, as claimed in claim 1, wherein said upper side comprises a tread pattern for minimizing slipping thereon.

3. A modular bench unit, as claimed in claim 1, wherein said bench protudes from said vertical wall below the swimming pool water line.

4. A modular bench unit, as claimed in claim 1, wherein said vertical wall includes at least one hydrotherapy jet providing a flow of water into the bench seating area.

5. A modular bench unit, as claimed in claim 4, wherein a plurality of hydrotherapy jets are spaced apart along said vertical wall above the upper side of said bench and below the water line of said swimming pool.

6. A modular bench unit, as claimed in claim 1, wherein said bench has a length sufficient to accommodate two or more occupants seated thereon.

7. A modular bench unit, as claimed in claim 1, wherein said upper side of said bench protrudes from said vertical wall at substantially a right angle thereto.

8. A modular bench unit, as claimed in claim 1, wherein said under side of said bench is spaced sufficiently from the floor of the swimming pool to allow occupants seated on said bench to position their lower legs beneath the bench.

9. A modular bench unit, as claimed in claim 1, wherein the elongate protruding side of said bench protrudes a sufficient distance from said vertical wall to allow occupants seated on said bench to kick their lower legs beneath the bench without striking their feet on said vertical wall.

10. A modular bench unit, as claimed in claim 1, wherein said vertical wall is straight.

11. A modular bench unit, as claimed in claim 1, wherein said vertical wall is arcuate.

* * * * *